US008376049B2

(12) United States Patent
Bell

(10) Patent No.: US 8,376,049 B2
(45) Date of Patent: Feb. 19, 2013

(54) RUNNING TOOL FOR DEEP WATER

(75) Inventor: Robert Bell, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 175 days.

(21) Appl. No.: 12/894,386

(22) Filed: Sep. 30, 2010

(65) Prior Publication Data

US 2012/0080193 A1 Apr. 5, 2012

(51) Int. Cl.
*E21B 19/00* (2006.01)

(52) U.S. Cl. ..... 166/339; 166/341; 166/351; 166/368; 166/85.1; 212/225

(58) Field of Classification Search ..... 166/339, 166/338, 340, 341, 351, 352, 368, 381, 85.1, 166/85.5; 405/158, 184.1; 414/137.5; 212/225, 212/228

See application file for complete search history.

(56) References Cited

U.S. PATENT DOCUMENTS

| | | | | |
|---|---|---|---|---|
| 3,568,767 | A * | 3/1971 | Weiss | 166/351 |
| 3,795,114 | A * | 3/1974 | De Cremiers et al. | 405/191 |
| 3,983,708 | A * | 10/1976 | Houot | 405/168.1 |
| 4,265,566 | A * | 5/1981 | Scodino | 405/172 |
| 4,457,378 | A * | 7/1984 | Watkins | 166/347 |
| 4,541,754 | A * | 9/1985 | Castel et al. | 405/168.1 |
| 4,601,610 | A * | 7/1986 | Campbell et al. | 405/188 |
| 4,643,616 | A * | 2/1987 | Castel et al. | 405/191 |
| 4,974,996 | A * | 12/1990 | Vielmo et al. | 405/188 |
| 5,622,451 | A * | 4/1997 | Lupi et al. | 405/158 |
| 6,095,349 | A * | 8/2000 | O'Meara | 212/180 |
| 6,422,315 | B1 * | 7/2002 | Dean | 166/339 |
| 6,460,621 | B2 | 10/2002 | Fenton et al. | |
| 6,622,799 | B2 * | 9/2003 | Dean | 166/381 |
| 6,926,467 | B1 * | 8/2005 | Andersen et al. | 405/191 |
| 7,096,963 | B2 * | 8/2006 | Moncus et al. | 166/381 |
| 7,121,344 | B2 | 10/2006 | Fenton et al. | |

(Continued)

FOREIGN PATENT DOCUMENTS

| | | | |
|---|---|---|---|
| GB | 1562614 | A | 3/1980 |
| GB | 2152979 | A | 8/1985 |

(Continued)

OTHER PUBLICATIONS

Amin et al. , "Subsea Development From Pore to Process", Oilfield Review (Spring 2005), pp. 4-17.

(Continued)

*Primary Examiner* — Thomas A Beach
*Assistant Examiner* — Matthew R Buck
(74) *Attorney, Agent, or Firm* — Bracewell & Giuliani LLP

(57) ABSTRACT

A running tool for use in handling control modules on a subsea production tree. The running tool is deployable on wire line and includes a column like body and a connector adapted for connection to the production tree. The running tool also includes a hoist system that is selectively positioned by a swiveling jib crane for handling the control modules. A replacement control module can be included with the running tool when the tool is deployed from above the sea surface. After the running tool connects to the production tree, the jib crane can position the hoist for attachment to and removal of an existing control module on the production tree. The hoist can then to attach to and install the replacement control module and can be further manipulated to retrieve the existing control module and stow it onto the body.

16 Claims, 3 Drawing Sheets

U.S. PATENT DOCUMENTS

| | | | | |
|---|---|---|---|---|
| 7,165,619 | B2 * | 1/2007 | Fox et al. | 166/343 |
| 7,201,229 | B2 | 4/2007 | White et al. | |
| 7,241,077 | B2 * | 7/2007 | Webster et al. | 405/195.1 |
| 7,331,394 | B2 * | 2/2008 | Edwards et al. | 166/339 |
| 7,360,589 | B2 * | 4/2008 | Moncus et al. | 166/77.51 |
| 8,006,765 | B2 * | 8/2011 | Richards et al. | 166/351 |
| 8,028,752 | B2 * | 10/2011 | Richards | 166/339 |
| 8,056,634 | B2 * | 11/2011 | Spencer | 166/341 |
| 2007/0131429 | A1 | 6/2007 | Brammer | |
| 2007/0246220 | A1 | 10/2007 | Fenton | |
| 2010/0230110 | A1 | 9/2010 | Voss | |
| 2010/0307760 | A1 * | 12/2010 | Shouse | 166/339 |
| 2011/0240303 | A1 * | 10/2011 | Hallundbaek | 166/339 |

FOREIGN PATENT DOCUMENTS

| | | | |
|---|---|---|---|
| GB | 2410757 | A | 8/2005 |
| WO | 2006027553 | A1 | 3/2006 |
| WO | 2010131010 | A2 | 11/2010 |

OTHER PUBLICATIONS

GB Search Report issued Nov. 18, 2011 from corresponding Application No. GB1116582.6.

* cited by examiner

RUNNING TOOL FOR DEEP WATER

1. FIELD OF THE INVENTION

This invention relates in general to production of oil and gas wells, and in particular to a device and method for delivery and/or retrieval of modules used in conjunction with subsea hydrocarbon production.

2. DESCRIPTION OF RELATED ART

Subsea wellbores are formed from the seafloor through subterranean formations lying underneath. Systems for producing oil and gas from subsea wellbores typically include a subsea wellhead assembly set over a wellbore opening. A typical subsea wellhead assembly includes a high pressure wellhead housing supported in a lower pressure wellhead housing and secured to conductor casing that extends downward past the wellbore opening. Wells are generally lined with one or more casing strings coaxially inserted through, and significantly deeper than, the conductor casing. The casing strings are suspended from casing hangers landed in the wellhead housing. One or more tubing strings are provided within the innermost casing string; that among other things are used for conveying well fluid produced from the underlying formations. A production tree mounts to the upper end of the wellhead housing for controlling the well fluid. The production tree is typically a large, heavy assembly, having a number of valves and controls mounted thereon Controls mounted on a production tree may be in the form of a subsea control module. Typically, subsea control modules are modular devices that regulate a supply of hydraulic fluid to subsea actuators, where the actuators are generally used to open and/or close a valve or valves. A choke bridge module is another type of module that is sometimes found on a production tree. Choke bridge modules generally regulate production flow from a production tree with an integrated flow restriction. Subsea control modules and choke bridge modules typically require replacement, installation, or removal during the operational life of the subsea wellhead assembly.

SUMMARY OF THE INVENTION

Disclosed herein is a running tool for handling a control module attachable to a subsea production tree. In an example embodiment the running tool includes a body having a connector that attaches to a subsea wellhead assembly. Also included is a swivel on the body distal from the connector that rotates about an axis of the body. A hoist assembly is included that couples with the swivel.

Also disclosed is a method of handling a control module subsea. In an example embodiment the method includes providing a running tool, where the running tool includes a body having an axis and a hoist assembly. The running tool is deployed subsea on a wire line to a subsea wellhead assembly and a control module is retrieved from the wellhead assembly using the hoist assembly.

DETAILED DESCRIPTION OF THE INVENTION

Figure 1:
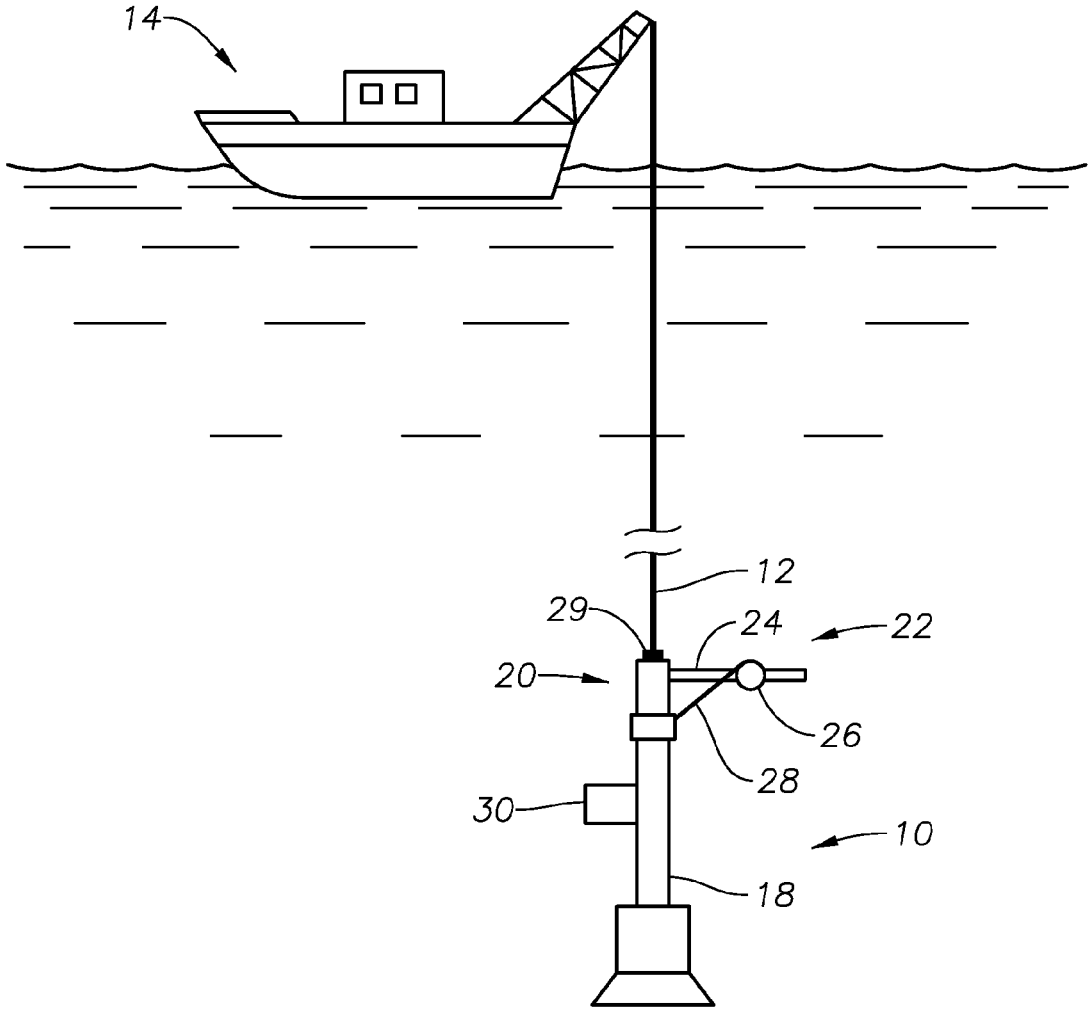
FIG. 1 is a side partial sectional view of an example embodiment of a running tool being lowered to a subsea wellhead assembly.
Figure 1:
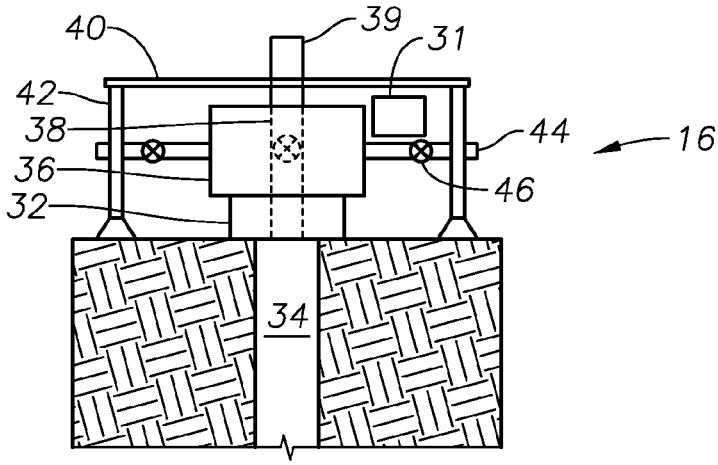

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Referring now to FIG. 1, a side view of a running tool 10 is shown being deployed subsea on lift line 12. In the example of FIG. 1, the lift line 12 is being reeled from a vessel 14 shown at the sea surface. In the example of FIG. 1, the vessel 14 is a workboat of the type typically used for subsea operations. Optionally, the vessel 14 can be an offshore rig, a floating production storage and offloading vessel (FPSO), or any type of vessel used for operations associated with a subsea assembly.

The running tool 10 is shown being lowered towards a subsea wellhead assembly 16 shown disposed at the sea floor. The running tool 10 includes a body 18, which in an example embodiment, is an elongate substantially cylindrical member. Shown on an upper end of the body 18 is a swivel portion 20 that is substantially coaxial with the body 18 and rotatable about an axis. A portion of a hoist assembly 22 attaches to a side of the swivel portion 20 and includes a jib or boom 24 shown as an elongated member that projects radially outward from the swivel portion 20. Supported on the jib 24 is a pulley 26 that is selectively movable along the length of the jib 24. A line 28, separate from the lift line 12, extends between the pulley 26 and the body 18. The running tool 10 attaches to the lift line 12 with a lift line attachment 29 shown coupled between the lift line 12 and swiveling portion 20. A replacement choke bridge module 30 is shown attached on a lateral side of the body 18. Choke bridge module 30 is releaseably parked on the body 18 and is a component to be attached to subsea equipment. In an example embodiment, the choke bridge module 30 can be deployed with the running tool 10 and used to replace an existing choke bridge module 31 shown provided with the wellhead assembly 16. The choke bridge modules 30, 31 can be used for regulating and/or diverting flow produced or otherwise flowing from the subsea wellhead assembly 16.

Still referring to FIG. 1, the wellhead assembly 16 includes a wellhead housing 32 set over a well bore 34 bored through formation beneath the sea floor. A production tree 36 attaches to an upper end of the wellhead housing 36. A main bore 38 (shown in phantom line) extends substantially vertically through the wellhead housing 32 and production tree 36. A swab valve in the main bore 38 controls access through the main bore 38. An annular tree mandrel 39 is shown projecting upward from the production tree 36 from the main bore 38 and through a rectangular top plate 40. Column struts 42 support the top plate 40 over the production tree 36. Also included with the subsea wellhead assembly 16 are flow lines 44 coupled to lateral sides of the production tree 36. The flow lines 44 each include a wing valve 46 therein for controlling and regulating flow through the flow lines 44.

Figure 2:
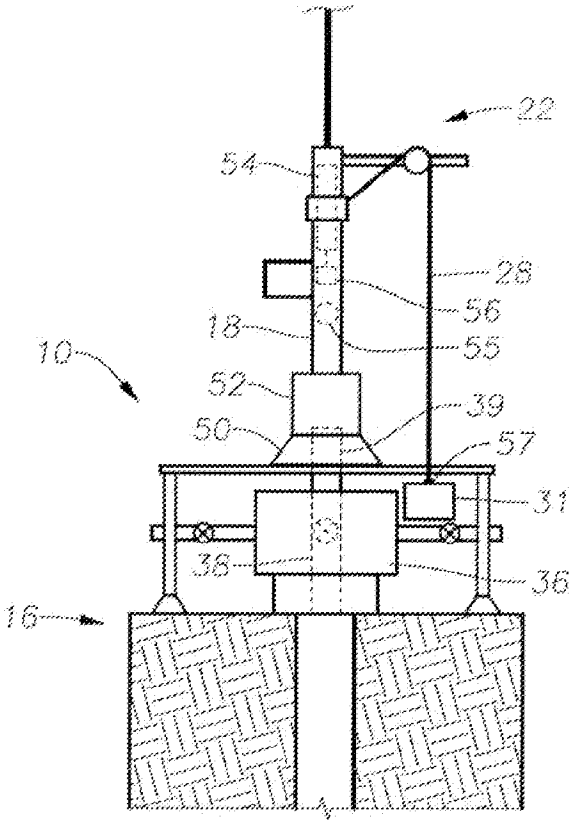

In FIG. 2 the running tool 10 is shown landed on the wellhead assembly 16 with the body 18 substantially coaxial with the main bore 38 and tree mandrel 39. The running tool 10 is shown having a funnel 50 on its lower most portion to facilitate landing onto the tree mandrel 39. The funnel 50 is a conically shaped annular member with an opening on a lower end and an inner circumference that narrows with distance away from the opening. The funnel 50 can help to guide the running tool 10 to a desired orientation with the tree mandrel 39. Shown adjacent the funnel 50 is a connector 52 that can be manipulated to grapple the outer circumference of the tree mandrel 39 to rigidly attach the running tool 10 to the wellhead assembly 16. In an example embodiment the connector 52 is annular and includes clamps on an inner circumference that can selectively attach on the outer circumference of the tree mandrel 39. One example embodiment the connector 52 is a Vetco MDH4 connector.

The example of FIG. 2 further illustrates the line 28 having been reeled out from the running tool 10 to have an attachment end extending past the hoist assembly 22. The attachment end of the line 28 is connected with the existing choke bridge module 31. In an example embodiment, an actuator 54 is illustrated set within the body 18 for supplying the line 28 from the running tool 10. In one example, the actuator 54 includes gears (not shown) connected to a spool or reel 55 within the body 18. The line 28 can be stored on the reel 55 within the body 18 and then reeled out for connection to the choke bridge module 31, or other object. The actuator 54 may be powered by a motor 56, also shown within the housing 18 and connected to the actuator 54 via a shaft. Other connection means such as belts or chains may be employed as well. To effectuate connection between the line 28 and choke bridge module 31 a connector 57 is illustrated that can selectively couple to the original or existing choke bridge module 31 as well as the replacement choke bridge module 30.

Figure 3:
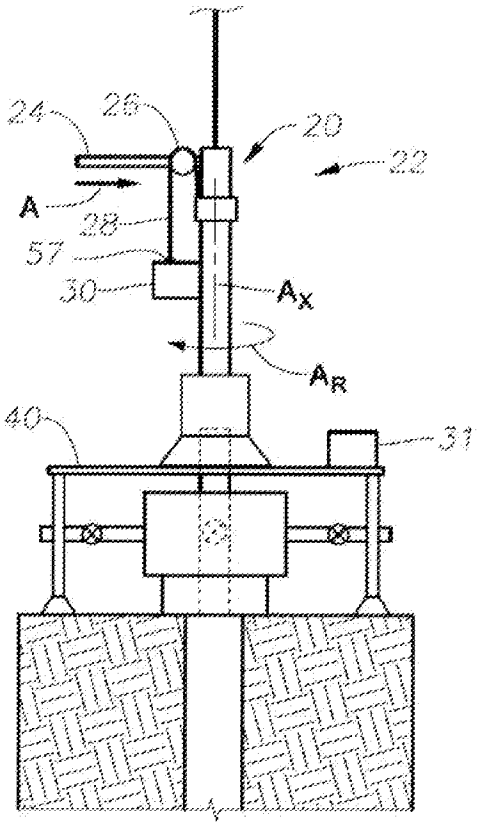
FIGS. 2-4 are side partial sectional views of the running tool of FIG. 1 coupled to the subsea wellhead assembly and replacing a subsea module on the wellhead assembly.

Referring now to FIG. 3 the existing choke bridge module 31 has been released and lifted from its original location on the subsea wellhead assembly 16 and parked on the top table 40. Additionally, the hoist assembly 22 is further manipulated so that the swivel 20 rotates about the axis $A_X$ thereby aligning the line 28 with the replacement choke bridge module 30. Also optionally, as indicated by the arrow A, the reel 26 has been moved radially inward along the boom 24 for a precise alignment with the replacement choke bridge module 30. Additionally, the line 28 is shown connected to the replacement choke bridge module 30 via connector 57. Arrow $A_R$ illustrates one example direction of swiveling rotation of the swivel 20.

Figure 4:
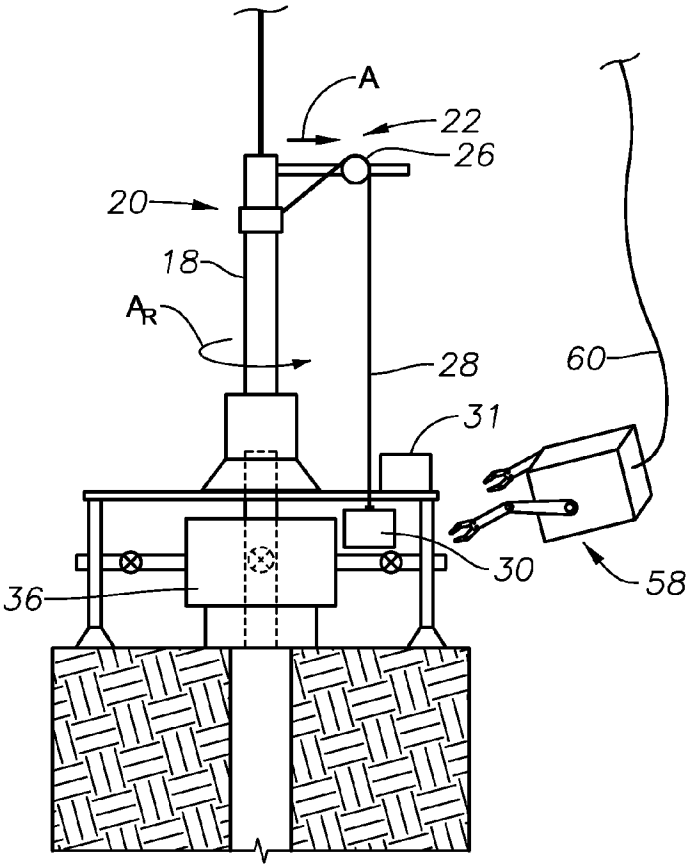

Referring to FIG. 4, the hoist assembly 22 is further actuated in a position to land the replacement choke bridge module 30 in the same location where the original choke bridge module 31 was located. Rotational swiveling movement of the swivel 20 is shown by arrow $A_R$ and lateral movement of the pulley 26 is illustrated by arrow A. A remotely operated vehicle 58 is illustrated that may be used to assist in positioning the replacement choke bridge module 30 on the production tree 36. A control tether 60 attaches to an end of the ROV and used for powering and/or control of the ROV. In the example of FIG. 4, the original choke bridge module 31 and replacement control module are modules having a choke bridge for regulating flow from the production tree 36 to processing or other terminal locations.

Figure 5:
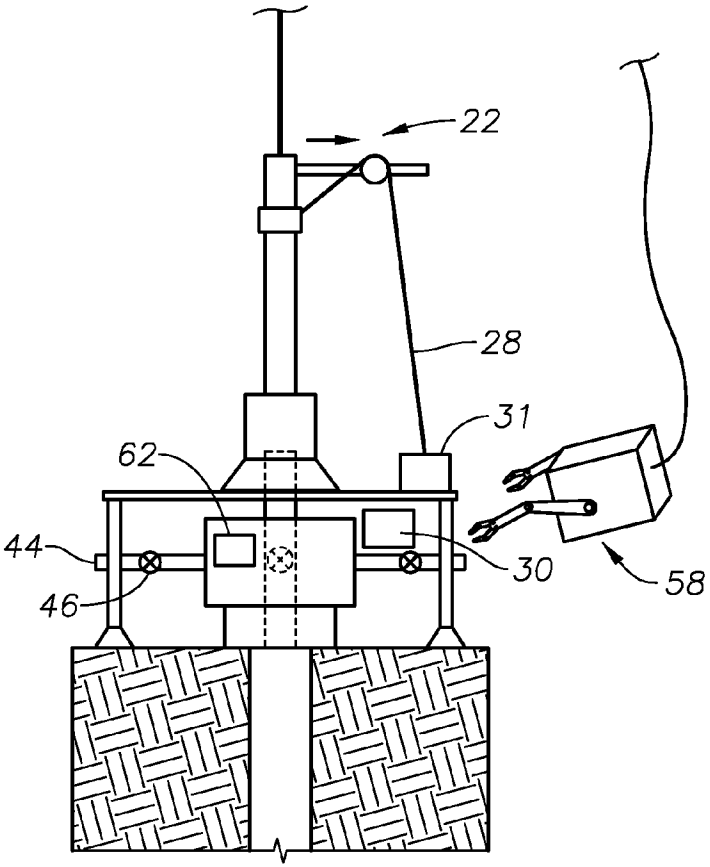
FIG. 5 is a side partial sectional view of the running tool of FIG. 1 removing a subsea module from the wellhead assembly.

Optionally, as shown in FIG. 5, the procedures described herein may be used to replace a subsea control module 62 shown attached to the production tree 36. The subsea control module 62 can be used for control of actuators associated with the subsea wellhead assembly 16, such as for opening and closing the swab valve and/or wing valves. In an example embodiment, subsea control module 62 includes hardware and software for controlling operation of systems within or associated with the subsea wellhead assembly 16. For example, the flow of electricity or hydraulics may be regulated through the subsea control module 62 for actuating movable devices, such as valves, located on the subsea wellhead assembly 16.

While the invention has been shown or described in only some of its forms, it should be apparent to those skilled in the art that it is not so limited, but is susceptible to various changes without departing from the scope of the invention. For example, in addition to the modules 30, 31, 62 discussed above, other wellhead components may be replaced or installed using the devices and methods provided herein. Such additional components include choke inserts, sand detectors, and flow control devices. Thus, in an example embodiment, a hoist assembly 22 could be deployed having one or more of a choke bridge module, subsea control module, a choke insert, a sand detector, flowmeter control unit, and a flow control device. Moreover, the hoist assembly 22 can also carry with it the tools for replacing any of the components, such as an interface tool. In an example embodiment, an interface tool is included with the connector 57 for interfacing with the component being replaced. One advantage of the device and method described herein is the running tool 10 can be lowered subsea at a rate of descent so it "softly" lands on the wellhead assembly 16 without imparting a damaging impulse in the running tool 10 or component being replaced.

What is claimed is:

1. A running tool for replacing a component of a subsea production tree comprising:

a body having an axis and configured for deployment subsea to a subsea wellhead assembly;

a connector on an end of the body that selectively attaches to the subsea wellhead assembly; and a hoist assembly on the body comprising, a winch, a jib, a line support selectively moveable between a position proximate the body, positions along a length of the jib, and a position distal from the body, and a line having an end coupled, with the winch and a middle portion supported on the line support.

2. The naming tool of claim 1, further comprising a swivel on the body distal from the connector that rotates the hoist assembly selectively about the axis of the body, so that the line depends downward from the line support and into selective engagement with an object on the body.

3. The running tool of claim 2, further comprising a motor in the body and attached to the swivel for rotating the swivel.

4. The running tool of claim 1, further comprising a motor in the body that rotates the winch.

5. The running tool of claim 1, wherein the line support comprises a pulley.

6. The running tool of claim 1, further comprising a replacement component for a subsea well.

7. The running tool of claim 1, further comprising a parking location on a lateral side of the body for releasably carrying a subsea component, and wherein the body is an elongate substantially cylindrical member.

8. The running tool of claim 1, further comprising a lift line attachment on the body for connecting to a lift line of a surface platform to lower the running tool from the surface platform.

9. The running tool of claim 1, further comprising a funnel attachment depending from a lower end of the connector for guiding the running tool onto a production tree mandrel.

10. The running tool of claim 1, further comprising a connector on an end of the line and that is selectively attached to a component for the subsea wellhead tree.

11. A method of handling a control module subsea comprising:

providing a running tool comprising: a body having an axis, a swivel on the body that is selectively rotated about the axis of the body, a hoist assembly mounted on the swivel, a winch, and a line having an end coupled with the winch;

providing a, replacement component onto the body;

deploying the running tool subsea on a lift line to a subsea wellhead assembly;

connecting the body to the subsea wellhead assembly;

swiveling the hoist assembly to an angular position about the axis of the body to position the line with a subsea component;

attaching an end of the line distal from the winch to the subsea component, and reeling the line onto the winch to raise the subsea component towards the running tool;

releasing the subsea component from the hoist assembly;

rotating the swivel to align the hoist assembly with the replacement component;

attaching the line to the replacement component;

using the hoist assembly to move the replacement subsea component from the body onto the subsea wellhead assembly;

disconnecting the body from the wellhead assembly; and retrieving the running tool from the wellhead assembly.

12. The method of claim 11, further comprising stowing the retrieved component onto the body.

13. The method of claim 11, wherein the replacement subsea component replaces the subsea component on the wellhead assembly.

14. The method of claim 13, wherein the replacement subsea component is moved from the body to the subsea wellhead assembly in the location from where the original subsea component was retrieved.

15. The method of claim 11, further comprising using a remotely operated vehicle in conjunction with the running tool.

16. The method of claim 11, wherein only a wire line is used for deploying the running tool.

* * * * *